US010661986B2

(12) United States Patent
Price et al.

(10) Patent No.: US 10,661,986 B2
(45) Date of Patent: May 26, 2020

(54) REFUSE COLLECTION VEHICLE WITH TELESCOPING ARM

(75) Inventors: Thomas L. Price, Mentone, AL (US); John Bares, Pittsburgh, PA (US); Robert H. Doll, Pittsburgh, PA (US); Brian T. Parker, Signal Mountain, TN (US)

(73) Assignee: The Heil Co., Chattanooga, TN (US)

( * ) Notice: Subject to any disclaimer, the term of this patent is extended or adjusted under 35 U.S.C. 154(b) by 382 days.

(21) Appl. No.: 13/570,504

(22) Filed: Aug. 9, 2012

(65) Prior Publication Data

US 2013/0039728 A1 Feb. 14, 2013

Related U.S. Application Data

(60) Provisional application No. 61/522,552, filed on Aug. 11, 2011.

(51) Int. Cl.
*B65F 3/04* (2006.01)
*B65F 3/02* (2006.01)

(52) U.S. Cl.
CPC ..... *B65F 3/043* (2013.01); *B65F 3/046* (2013.01); *B65F 2003/022* (2013.01); *B65F 2003/023* (2013.01); *B65F 2003/0256* (2013.01); *B65F 2003/0266* (2013.01); *B65F 2003/0276* (2013.01); *B65F 2003/0283* (2013.01)

(58) Field of Classification Search
CPC ..... B65F 3/0213; B65F 3/043; B65F 3/046; B65F 2003/0256; B65F 2003/0266; B65F 2003/0276; B65F 2003/0283; B65F 2003/0286
USPC ..... 414/408, 421, 555, 699–701, 716, 732, 414/733, 686; 212/180
See application file for complete search history.

(56) References Cited

U.S. PATENT DOCUMENTS

| | | | | |
|---|---|---|---|---|
| 2,503,423 A * | 4/1950 | Silverman | G01C 7/04 235/61 C |
| 2,592,324 A | 4/1952 | Oliver | |
| 2,808,947 A | 10/1957 | Shippy | |
| 2,873,873 A * | 2/1959 | Fowler | B66F 9/18 212/180 |
| 2,876,921 A * | 3/1959 | Salna | E02F 3/433 414/700 |
| 2,933,210 A * | 4/1960 | Dye | 414/547 |
| 3,136,436 A | 6/1964 | Erlinder et al. | |
| 3,516,562 A | 6/1970 | Knight | |

(Continued)

FOREIGN PATENT DOCUMENTS

| | | | |
|---|---|---|---|
| EP | 0078011 A1 * | 5/1983 | B65F 3/048 |
| EP | 0638491 A1 * | 2/1995 | B65F 3/08 |
| NZ | 620216 | 5/2016 | |

OTHER PUBLICATIONS

Australian Examination Report in Australian Application No. 2017202399, dated Jun. 5, 2018, 7 pages.

(Continued)

*Primary Examiner* — James Keenan
(74) *Attorney, Agent, or Firm* — Fish & Richardson P.C.

(57) ABSTRACT

A refuse collection vehicle has a container collection arm with a telescoping boom coupled with a refuse stowage unit of the vehicle. A grasping mechanism is coupled with an end of the boom. A rotary actuator couples the grasping mechanism with the boom to enable a waste container to be moved between a pick up position and a dump position.

18 Claims, 16 Drawing Sheets

(56) References Cited

U.S. PATENT DOCUMENTS 3,762,586 A * 10/1973 Updike, Jr. ..... B65F 3/04 414/408
3,765,554 A * 10/1973 Morrison ..... B65F 3/04 414/408
3,773,197 A 11/1973 Blakeley et al.
3,786,949 A 1/1974 Sutton
3,827,587 A * 8/1974 Liberman ..... B65F 3/04 414/408
3,844,434 A 10/1974 Blakeley et al.
3,858,927 A 1/1975 Sutton
3,881,616 A 5/1975 Blakeley et al.
3,910,434 A 10/1975 Eberling et al.
3,944,092 A 3/1976 Eberling et al.
4,057,156 A 11/1977 Thompson et al.
4,063,628 A * 12/1977 Jenkins ..... B28C 5/4244 193/10
4,085,857 A * 4/1978 Smith ..... B65F 3/04 414/408
4,091,944 A * 5/1978 Gollnick ..... B65F 3/04 414/408
4,175,903 A 11/1979 Carson
4,219,298 A 8/1980 Stragier et al.
4,227,849 A 10/1980 Worthington
4,276,975 A * 7/1981 Jenkins ..... B60P 3/16 180/41
4,313,707 A 2/1982 Bingman et al.
4,316,695 A 2/1982 Knight, Sr.
4,401,407 A 8/1983 Breckenridge
4,427,333 A 1/1984 Ebeling
4,461,608 A 7/1984 Boda
4,535,847 A * 8/1985 Hasegawa ..... A01B 63/1117 172/2
4,543,028 A 9/1985 Bell et al.
4,553,605 A * 11/1985 Katayama ..... A01B 63/114 172/2
4,597,710 A 7/1986 Kovats
4,647,267 A * 3/1987 Hund, Jr. ..... B65F 3/04 414/408
4,669,940 A 6/1987 Englehardt et al.
4,708,570 A 11/1987 Smith et al.
4,726,726 A 2/1988 Dossena et al.
4,854,406 A * 8/1989 Appleton et al. ..... 177/139
4,872,801 A 10/1989 Yeazel et al.
4,915,570 A 4/1990 Rath et al.
4,981,411 A 1/1991 Ramsey
4,983,092 A 1/1991 Richards
5,002,450 A 3/1991 Naab
5,007,786 A 4/1991 Bingman
5,020,844 A 6/1991 Pickrell
5,026,104 A 6/1991 Pickrell
5,035,563 A 7/1991 Mezey
5,044,863 A 9/1991 LaBass et al.
5,049,026 A * 9/1991 Bingman ..... B65F 3/08 414/408
5,092,731 A 3/1992 Jones et al.
5,163,805 A 11/1992 Mezey
5,186,397 A 2/1993 Orlando
5,205,698 A 4/1993 Mezey
5,209,312 A 5/1993 Jensen
5,209,537 A 5/1993 Smith et al.
RE34,292 E 6/1993 Bingman et al.
5,215,423 A * 6/1993 Schulte-Hinsken et al. ..... 414/408
5,222,853 A 6/1993 Carson
5,230,393 A 7/1993 Mezey
5,304,744 A 4/1994 Jensen
5,330,308 A * 7/1994 Armando et al. ..... 414/408
5,360,310 A 11/1994 Jones et al.
5,391,039 A 2/1995 Holtom
5,398,983 A 3/1995 Ahrens
5,419,671 A 5/1995 Smith et al.
5,470,187 A 11/1995 Smith et al.
5,474,413 A 12/1995 Georg
5,505,576 A 4/1996 Sizemore et al.
5,513,937 A 5/1996 Huntoon et al.
5,513,942 A 5/1996 Pickrell
5,547,332 A 8/1996 Smith et al.
5,551,824 A 9/1996 Zanzig et al.
5,562,386 A 10/1996 Browning
5,577,877 A 11/1996 Smith et al.
5,601,392 A 2/1997 Smith et al.
5,651,654 A 7/1997 Christenson
5,695,016 A * 12/1997 Deeter ..... E21B 19/14 173/28
5,702,225 A 12/1997 Ghibaudo
5,711,565 A 1/1998 Smith et al.
5,720,589 A 2/1998 Christenson et al.
5,743,698 A 4/1998 Smith et al.
5,755,547 A 5/1998 Flerchinger et al.
5,759,008 A 6/1998 Smith et al.
5,769,592 A 6/1998 Christenson
5,769,594 A 6/1998 Kalua
5,775,867 A 7/1998 Christenson
5,813,818 A 9/1998 McNeilus et al.
5,813,824 A 9/1998 Zanzig et al.
5,833,429 A 11/1998 McNeilus et al.
5,846,044 A 12/1998 Smith et al.
5,851,100 A * 12/1998 Brandt ..... B65F 3/04 414/408
5,863,086 A 1/1999 Christenson
5,879,015 A 3/1999 Ramsey et al.
5,890,865 A * 4/1999 Smith ..... B65F 3/043 414/408
5,919,027 A 7/1999 Christenson
5,931,628 A 8/1999 Christenson
5,934,858 A 8/1999 Christenson
5,934,867 A 8/1999 Christenson
5,967,731 A 10/1999 Brandt
5,988,970 A 11/1999 Holtom
6,004,092 A 12/1999 Johnson et al.
6,007,291 A 12/1999 Ghibaudo
6,012,895 A 1/2000 Smith et al.
6,027,300 A 2/2000 Richards
6,071,058 A 6/2000 Tetz et al.
6,089,813 A 7/2000 McNeilus et al.
6,095,744 A 8/2000 Harrison
6,109,371 A * 8/2000 Kinnan ..... E21B 7/064 175/61
6,123,497 A * 9/2000 Duell ..... B65F 3/043 414/408
6,139,244 A * 10/2000 VanRaden ..... B65F 3/041 414/408
6,152,673 A * 11/2000 Anderson et al. ..... 414/408
6,174,126 B1 1/2001 Zanzig et al.
6,183,185 B1 2/2001 Zanzig et al.
6,210,094 B1 4/2001 McNeilus et al.
6,213,706 B1 4/2001 Christenson
6,350,098 B1 2/2002 Christenson et al.
6,390,758 B1 5/2002 McNeilus et al.
6,474,928 B1 11/2002 Christenson
6,491,489 B1 12/2002 Stragier
6,494,665 B1 12/2002 Bingman
6,520,008 B1 2/2003 Stragier
6,520,750 B2 * 2/2003 Eller ..... E03B 3/04 417/234
6,644,906 B2 11/2003 Bayne
6,655,894 B2 12/2003 Boivin
6,719,226 B2 4/2004 Rajewski
6,761,523 B2 7/2004 Hund, Jr. et al.
6,776,570 B1 8/2004 Thobe et al.
6,821,074 B2 11/2004 Schreiber et al.
7,037,061 B2 5/2006 Hund, Jr. et al.
7,066,514 B2 6/2006 Smith et al.
7,070,381 B2 7/2006 Khan et al.
7,072,745 B2 * 7/2006 Pillar ..... B65F 3/043 414/408
7,086,818 B2 8/2006 Pruteanu et al.
7,140,830 B2 * 11/2006 Berger ..... E02F 3/433 414/699
7,347,657 B2 3/2008 Brunn
7,452,175 B2 11/2008 Martin et al.

(56) References Cited

U.S. PATENT DOCUMENTS

| | | | | |
|---|---|---|---|---|
| 7,530,185 | B2 * | 5/2009 | Trifunovic | E02F 3/432 414/700 |
| 7,530,779 | B2 * | 5/2009 | Holloway | A01B 59/002 172/273 |
| 7,559,732 | B2 | 7/2009 | Khan et al. | |
| 7,559,733 | B2 | 7/2009 | Khan et al. | |
| 7,559,734 | B2 | 7/2009 | Khan et al. | |
| 7,559,735 | B2 | 7/2009 | Pruteanu et al. | |
| 7,871,233 | B2 | 1/2011 | Arrez et al. | |
| 8,827,559 | B2 * | 9/2014 | Gentry et al. | 384/42 |
| 8,857,024 | B2 * | 10/2014 | Goedken | B65F 3/043 414/408 |
| 8,886,415 | B2 * | 11/2014 | Shatters | E02F 3/432 414/700 |
| 9,428,334 | B2 * | 8/2016 | Whitfield, Jr. | B65F 3/041 |
| 2001/0001637 | A1 | 5/2001 | Zanzig et al. | |
| 2002/0159870 | A1 | 10/2002 | Pruteanu et al. | |
| 2003/0031543 | A1 * | 2/2003 | Elbrink | 414/408 |
| 2003/0130765 | A1 * | 7/2003 | Pillar et al. | 701/1 |
| 2003/0175104 | A1 | 9/2003 | Pruteanu | |
| 2005/0232736 | A1 | 10/2005 | Fellows et al. | |
| 2006/0280582 | A1 | 12/2006 | Kouri | |
| 2008/0199290 | A1 | 8/2008 | Traylor | |
| 2009/0067965 | A1 | 3/2009 | Martin et al. | |
| 2009/0317219 | A1 | 12/2009 | Pruteanu et al. | |
| 2010/0322749 | A1 | 12/2010 | Rowland et al. | |
| 2011/0038697 | A1 | 2/2011 | Arrez et al. | |
| 2011/0243692 | A1 | 10/2011 | Fortin et al. | |

OTHER PUBLICATIONS

International Search Report in International Application No. PCT/US2012/050084, dated Jun. 3, 2013, 3 pages.

CA Office Action issued in Canadian Application No. 2,842,827, dated Aug. 27, 2018, 4 pages.

CA Office Action issued in Canadian Application No. 2,842,827, dated May 30, 2019, 4 pages.

* cited by examiner

REFUSE COLLECTION VEHICLE WITH TELESCOPING ARM

CROSS-REFERENCE TO RELATED APPLICATIONS

This application claims the benefit of U.S. Provisional Application No. 61/522,552, filed on Aug. 11, 2011. The entire disclosures of the above applications are incorporated herein by reference.

FIELD

The present disclosure relates to refuse collection vehicles and, more particularly, to refuse collection vehicles that include a side loading collection arm.

BACKGROUND

Various types of refuse collection vehicles exist in the art. These vehicles include numerous types of pick up or collection arms. The collection arms usually move from a pick up position, picking up a garbage can at the curb, to a dump position, dumping the garbage can in a hopper. Ordinarily, these arms include various types of linkages to move the arm from one position to the other. These linkages utilize a number of parts as well as hydraulic cylinders. Due to the movement from one position to the other, the collection arms can be very complicated and include numerous parts. While these arms work satisfactory for their intended purpose, designers strive to improve the art.

When these collection arms require significant maintenance, it generally requires the entire collection arm being removed from the vehicle. Thus, this requires significant down time of the vehicle. Also, due to their complexity, the collection arms are substantially heavy and add additional weight to the vehicle.

The present disclosure provides the art with a refuse collection vehicle that overcomes the shortcomings of the prior devices. The present disclosure provides the art with a telescoping collection arm that includes a pivot bearing assembly that enables vertical movement of the collection arm. In addition, the pivot may slide along a track inside the hopper to provide additional horizontal movement of the arm. The pick up arm can be quickly removed from the pivot bearing assembly for replacement or substitution of other like arms. The collection arm includes a dynamic control to alter its vertical and horizontal movements which, in turn, alter the position of the gripping fingers. The collection arm and the bearing assembly are coupled with the vehicle body hopper to enable the collection arm to pivot with respect to the hopper.

SUMMARY

According to the disclosure, a refuse collection vehicle comprises a vehicle with a refuse stowage unit secured to the vehicle. A hopper is coupled with the refuse stowage unit to receive refuse. A collection arm is coupled with the vehicle to grasp containers and empty the containers in the hopper. The collection arm includes a telescoping boom coupled with the refuse stowage unit. A grasping mechanism is coupled with one end of the telescoping boom. The grasping mechanism is adapted to grasp containers. The grasping mechanism includes at least one rotatable actuator that moves the container from a pick up position to an empty position. The grasping mechanism includes at least one moveable finger to couple with the container to enable picking up of the container. The telescoping boom is pivotally secured to the refuse stowage unit. A pivot bearing assembly is coupled with the hopper to receive the telescoping boom. A cylinder is mounted on the hopper and is coupled with the telescoping boom. The cylinder enables movement of the boom in two degrees of freedom. The collection arm is readily removable from the vehicle. The collection arm may be replaced with a collection arm that accomplishes a different function such as the picking up of brush, cutting trees or the like. The collection arm enables pick up of containers above and below the street grade on which the vehicle is traveling.

According to a second object of the disclosure, a collection arm for a refuse vehicle comprises a telescoping boom adapted to be coupled with a refuse stowage unit. A grasping mechanism is coupled with one end of the telescoping boom. The grasping mechanism is adapted to grasp containers. The grasping mechanism includes at least one rotatable actuator to move the container from a pick up position to an empty position. The grasping mechanism includes at least one moveable finger to couple with the container to enable picking up of the container. The telescoping boom includes a pivot bearing assembly adapted to be pivotally secured to the refuse stowage unit. The pivot bearing assembly is adapted to be coupled with the hopper. A cylinder is coupled with the boom and adapted to be mounted on the hopper. The cylinder enables movement of the boom in two degrees of freedom of motion. The range of motion of the telescoping boom coupled with the rotary actuator assures that the container opening is always parallel, with the ground regardless of the grade. The collection arm is readily removable from the vehicle. A different grasping mechanism may be mounted on the collection arm that accomplishes a different function. The collection arm enables pick up of containers above and below the street grade on which the vehicle is traveling.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 7:
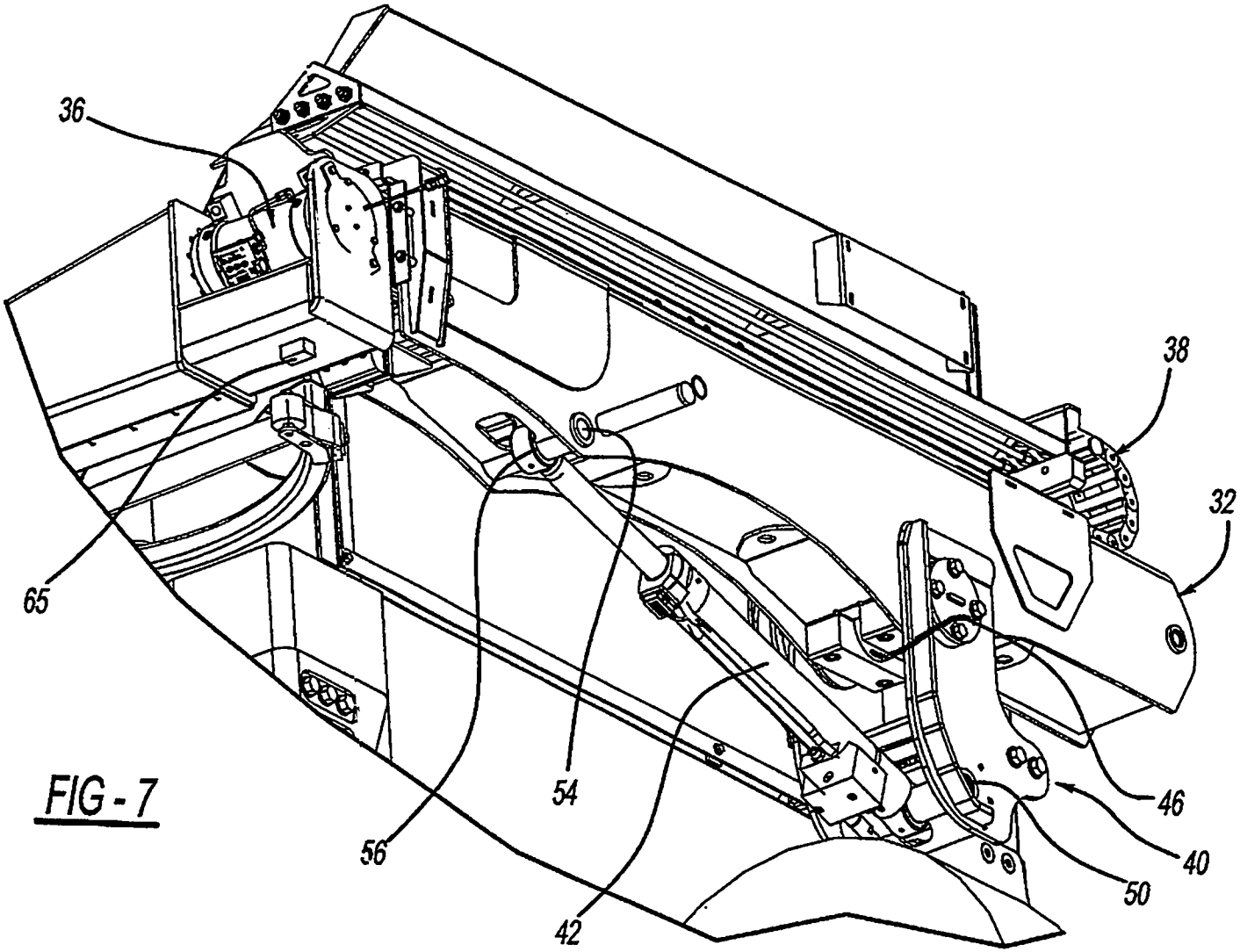
FIG. 7 is a perspective view illustrating the cylinder attached to the collection arm.
Figure 7A:
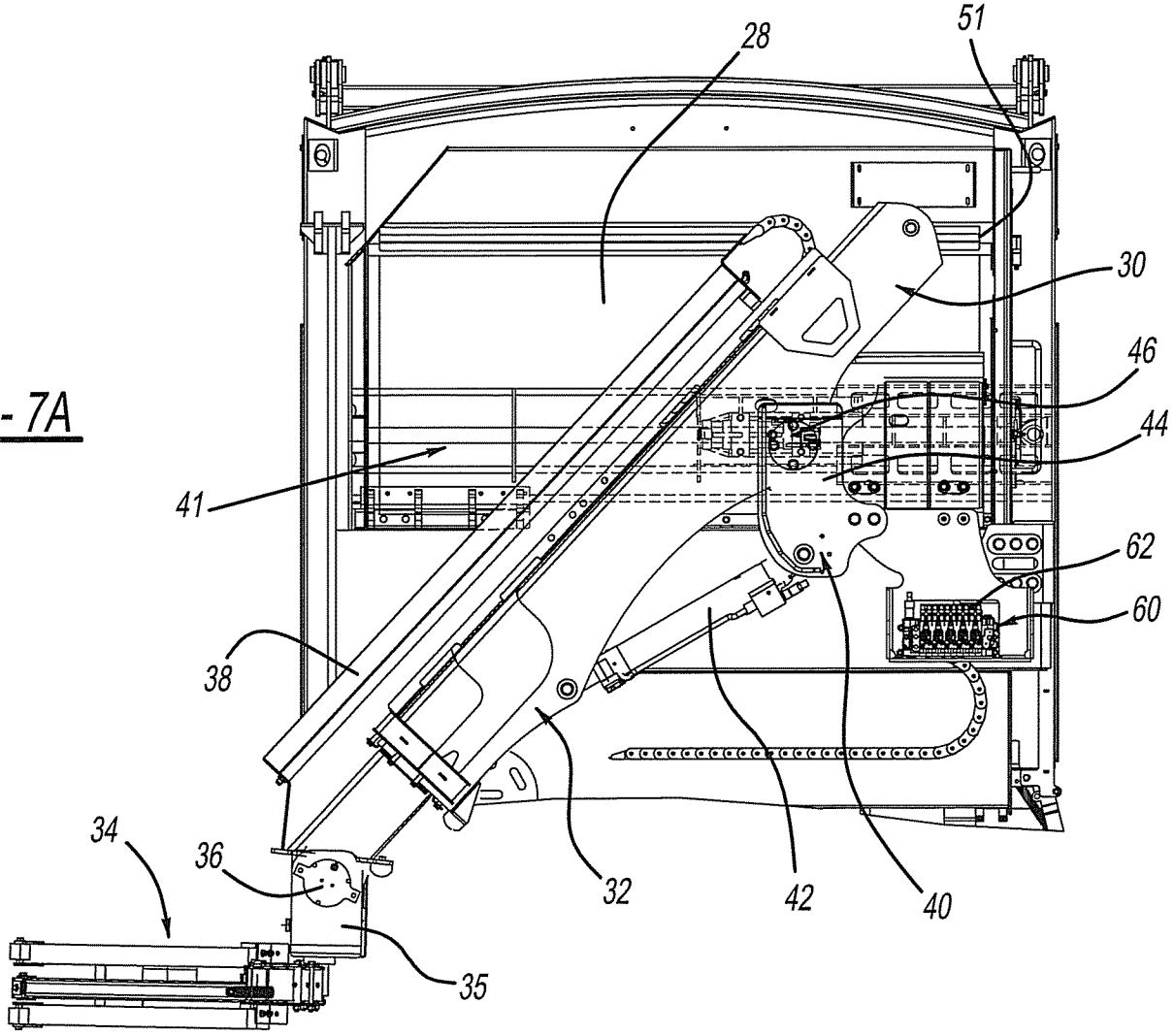

FIG. 7*a* is a view like FIG. 7 of an alternative embodiment of the pivot assembly.

Figure 7B:
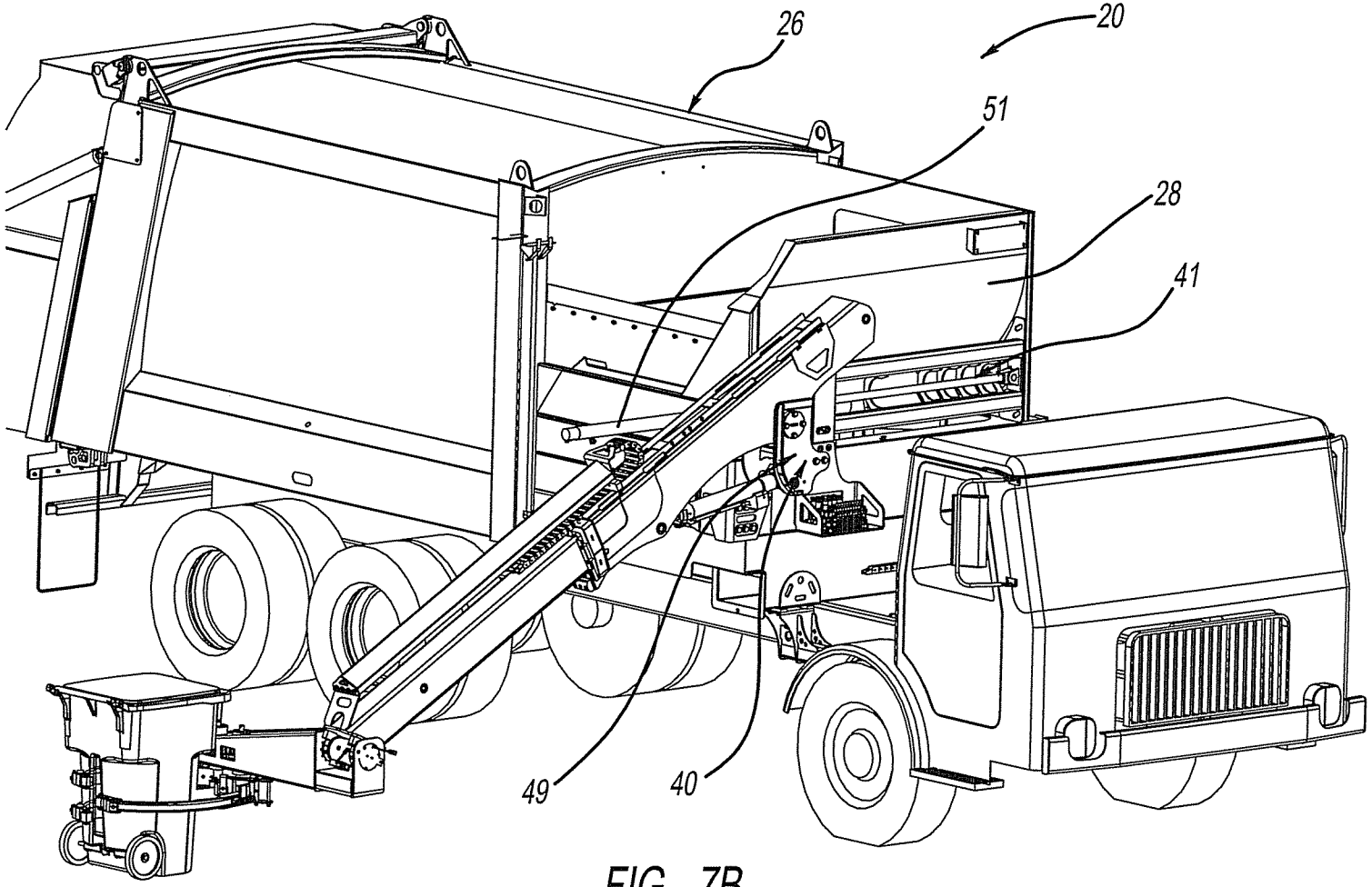

FIG. 7*b* is a view like FIG. 7*a* in an alternate position.

Figure 8:
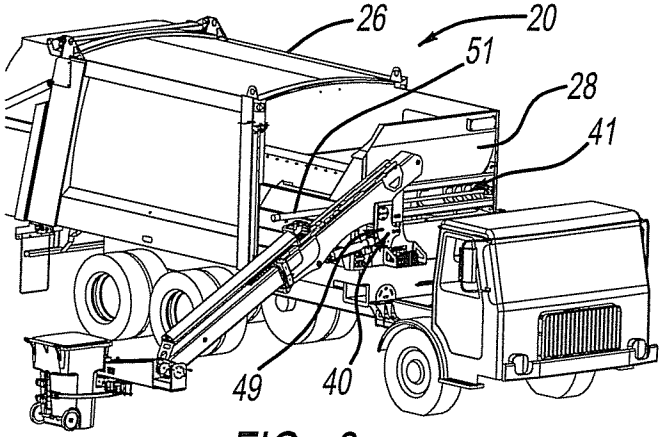

FIG. 8 is a perspective view of the refuse collection vehicle with the collection arm in an extended position.

Figure 9:
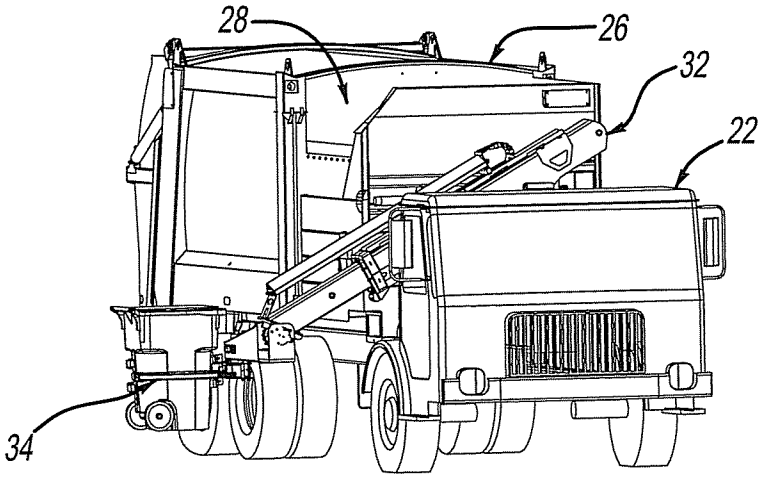

FIG. 9 is a perspective view of the refuse collection vehicle with the collection arm in a retracted position.

Figure 10:
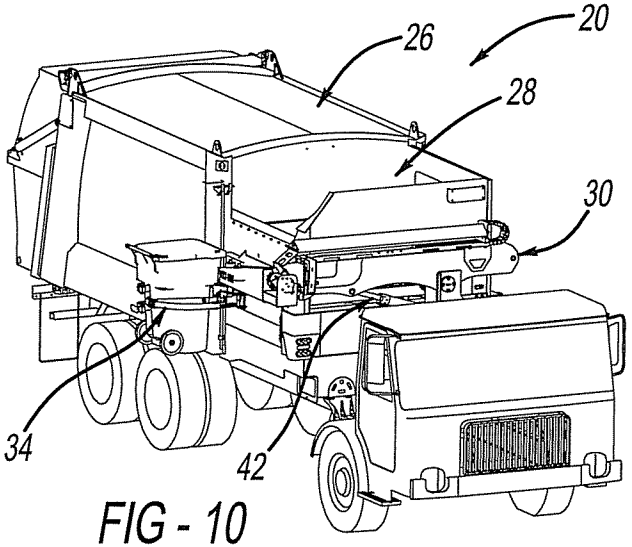

FIG. 10 is a view like FIG. 9 of the container being moved towards a dump position.

Figure 11:
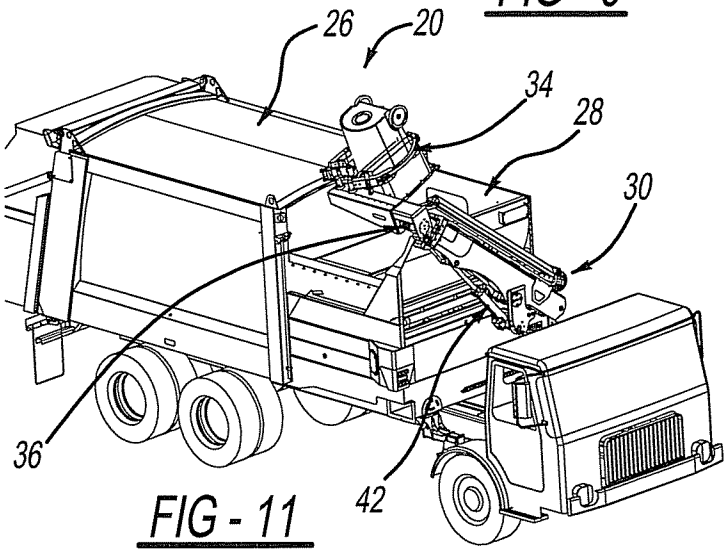

FIG. 11 is a perspective view of the refuse collection vehicle with the collection arm in a dump position.

Figure 12:
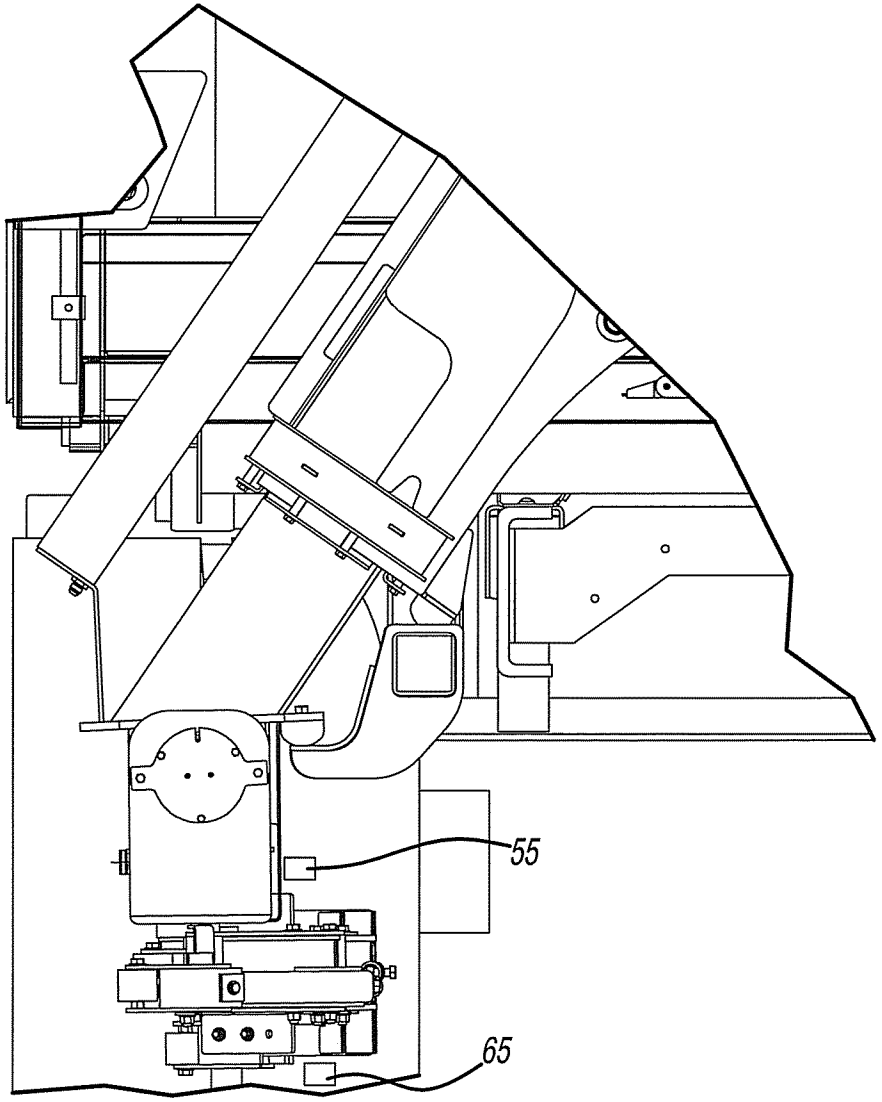

FIG. 12 is an elevation view of the grasping mechanism in a retracted position.

Figure 13:
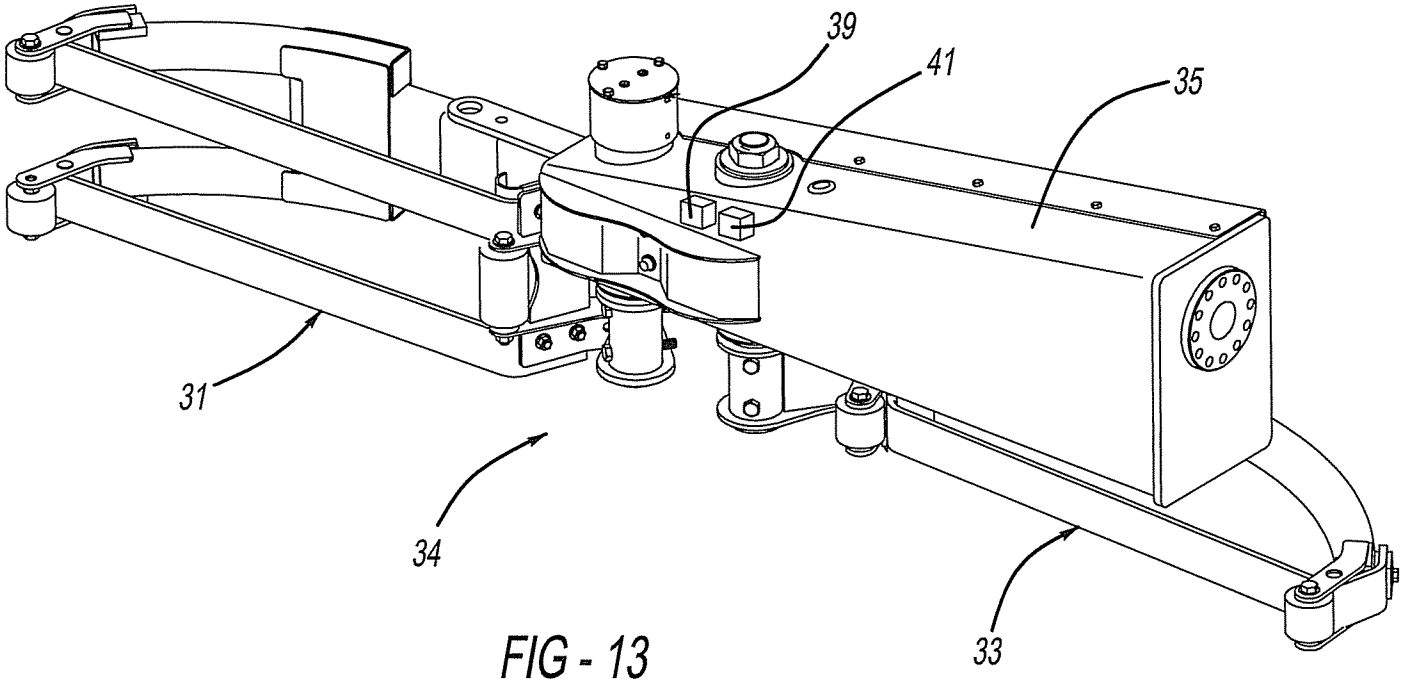

FIG. 13 is a perspective view of the grasping mechanism in a retracted position.

Figure 14:
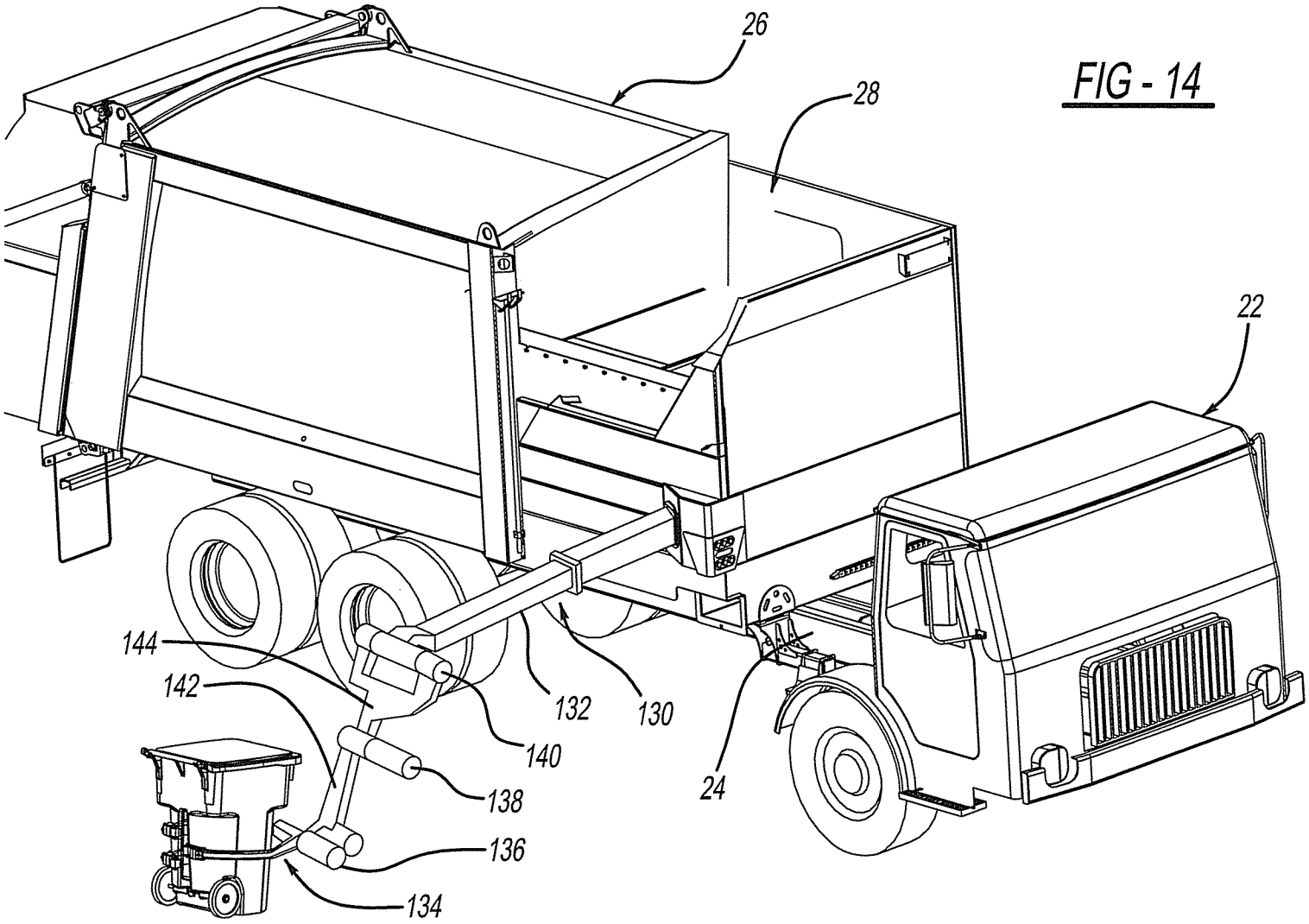

FIG. 14 is a perspective view of an additional embodiment of the refuse collection vehicle.

Figure 15:
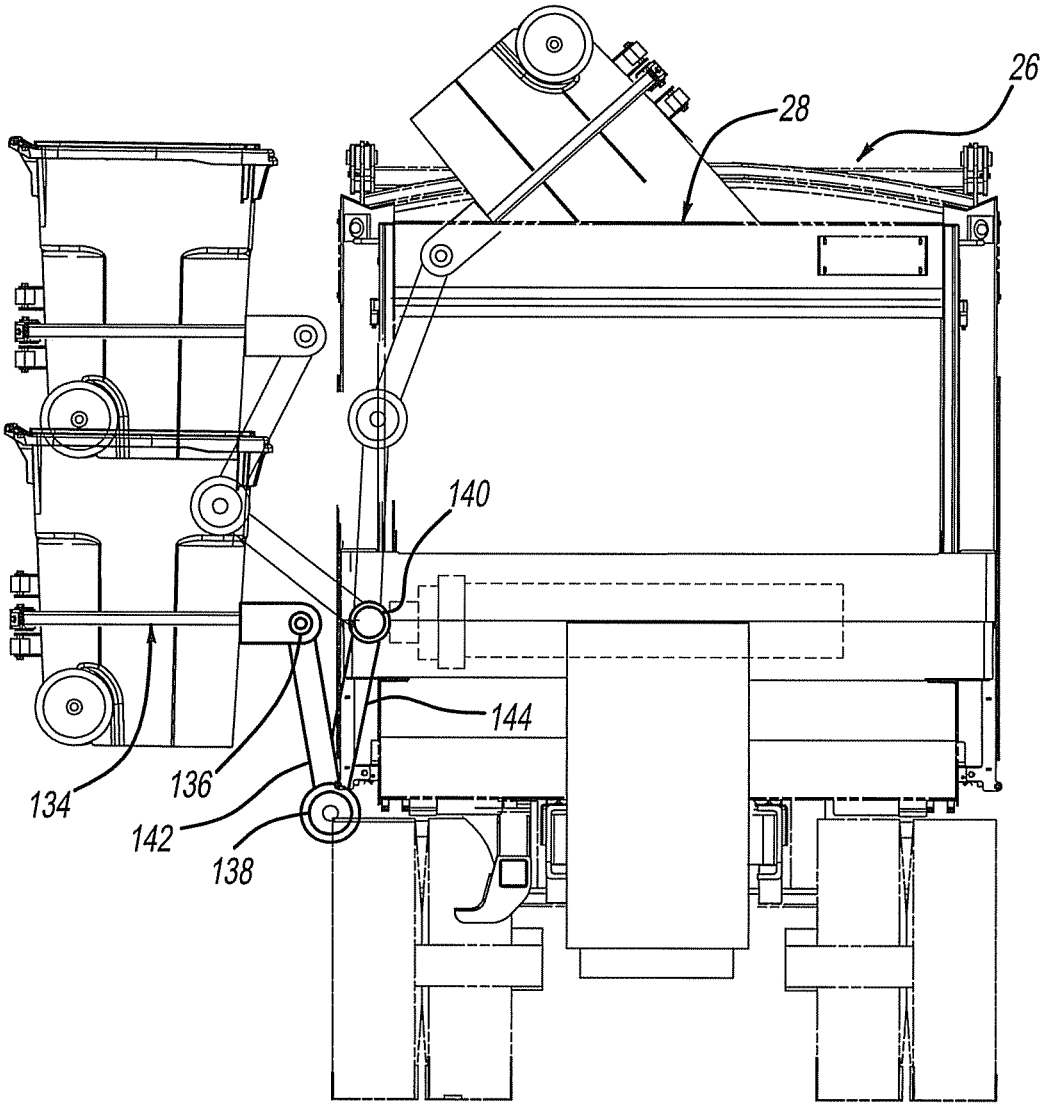

FIG. 15 is an elevation view of the collection arm of FIG. 14 moving between a pick up and a dump position.

Figure 16:
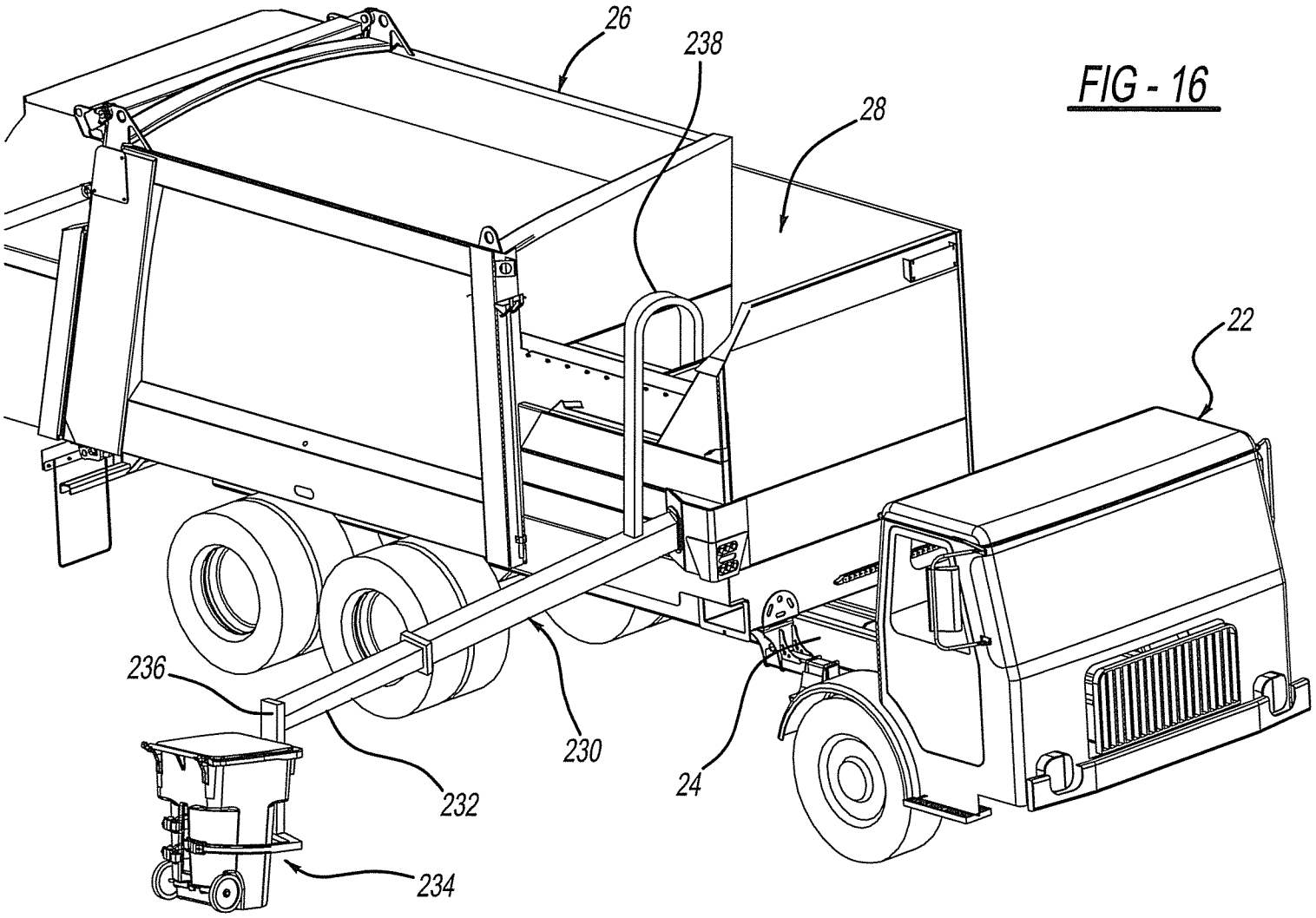

FIG. 16 is a perspective view of an additional embodiment of the refuse collection vehicle present invention with the collection arm in an extended position.

Figure 17:
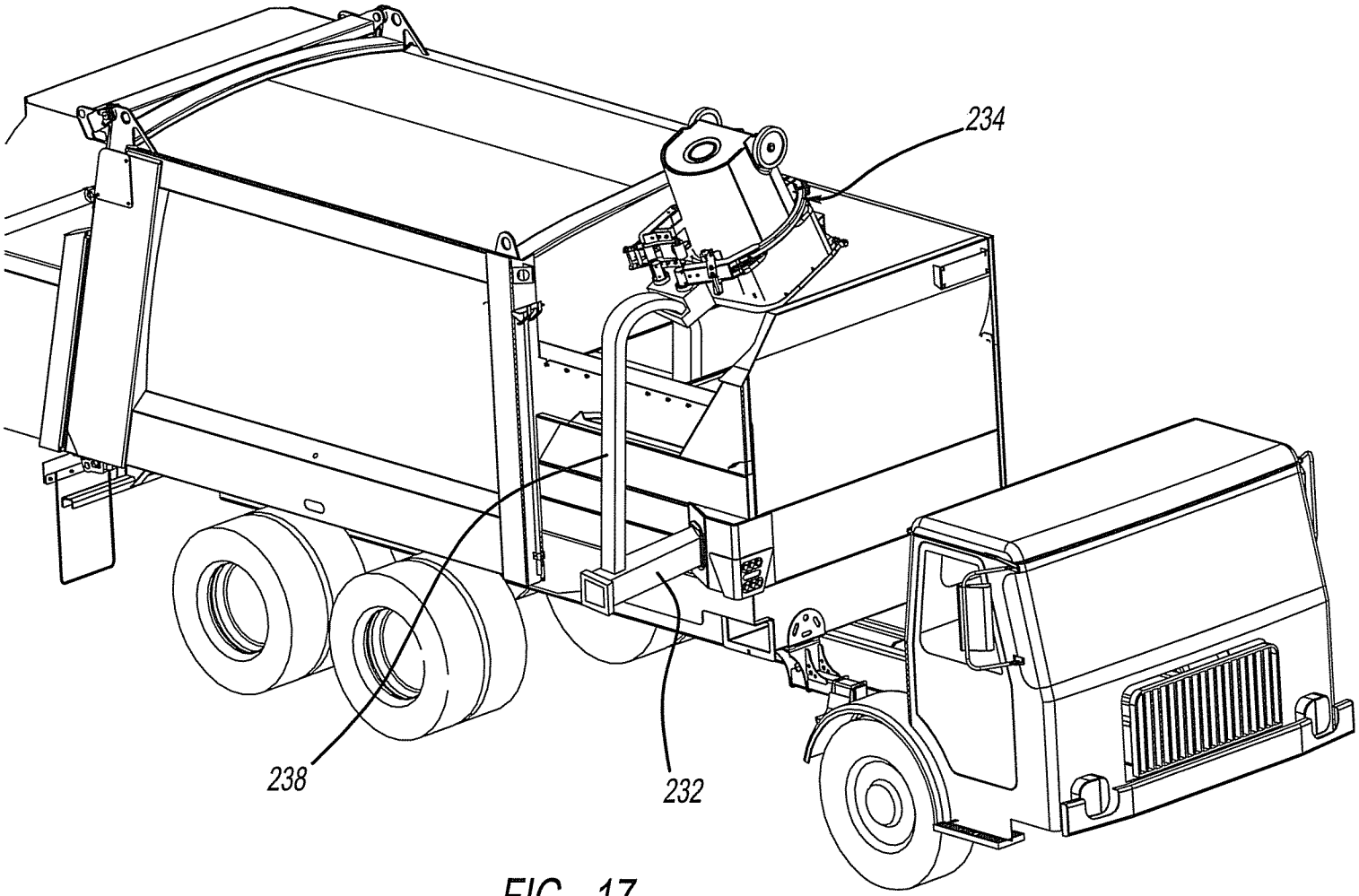

FIG. 17 is a perspective view of the refuse collection vehicle of FIG. 16 with the collection arm in a dump position.

DETAILED DESCRIPTION

Turning to the drawings, a refuse collection vehicle is illustrated and designated with the reference numeral 20. The refuse collection vehicle 20 includes a cab 22, a frame 24 and a refuse stowage unit 26. The refuse stowage unit 26 also includes a hopper 28. A container collection arm 30 is secured to the hopper 28.

The container collection arm 30 includes a telescoping boom 32 and a grasping assembly 34. The grasping assembly 34 is secured to the boom 32 via a rotary actuator 36. The rotary actuator 36 manipulates the grasping assembly 34 to level the container during lifting. Additionally, the rotary actuator 36 initiates dumping of the container into the hopper 28. A hose track 38, housing the hydraulic hoses, is positioned on the boom 30. The hydraulic hoses are carried by the hose track 38 to the rotary actuator 36 and grasping assembly. The hose track 38 moves along the boom 32 as best illustrated in FIGS. 3 and 8-11.

The grasping assembly 34 includes a link arm 35 coupled with the rotary actuator 36. Additionally, a pair of fingers 31, 33 is actuated from the link arm 35 to capture the container. In FIG. 13, the link arm 35 is illustrated in a non-offset position for close container gripping or a storage position. The fingers 31, 33 include sensors 39. The sensors 39 may be of the pressure or positioning type to enable proper positioning of the gripping mechanism fingers 31, 33 on the container prior to the dump sequence. Additionally, the fingers 31, 33 may include a sensor such as a load cell 41 or the like that enables a determination of the weight of the container prior to the dumping sequence. By determining the weight of the container, dynamically, this enables the speed of the arm 30, during the dump sequence, to be adjusted based upon the weight of the container. Thus, with a lightweight container, the boom 32 may operate rapidly through the dump sequence to dump the container. In the event the container is heavy (e.g., 100 to 300 lbs.), the boom 32 can lift the container slowly and proceed through the dump sequence to dump the container at a slower speed. Alternatively, the hydraulic system could be utilized, via an algorithm relating weight to the pressure/flow characteristics, to determine the weight of the container. Thus, the hydraulic pressure could be monitored to determine the weight and thus the sequence of dumping the container.

The boom 32 generally includes a plurality of stages that enable the boom 32 to telescope outward and inward to pick up and dump a container. The boom 32, with stages, can have a desired length and is preferably between 8 to 16 feet.

The boom 32 is secured onto the hopper 28 by a mounting assembly 40 and a movable cylinder 42. The mounting assembly 40 is secured to the hopper 28. The bearing journal enables the boom 32 to rotate about the bearing journal axis. The mounting assembly 40 includes a base 44. The base 44 includes the bearing journal 46 that receives the boom 32. The bearing journal is positioned inside of a base 44 that is secured to the hopper 28, as illustrated in FIGS. 6 and 7.

Alternatively, as illustrated in FIGS. 7*a* and 7*b*, a rail system 41 may be positioned on the hopper 28. The rail system 41 receives a bearing coupled with a bracket assembly 49. The bracket assembly 49 is slid along the rail system 41 via the cylinder 51. The mounting assembly 40 is secured to the bracket assembly 49. Thus, the mounting assembly 40 can be moved horizontally on the hopper 28 to provide additional horizontal movement and provide additional length for the telescoping boom 32 during pick up as well as a reduced length during storage.

The pivot cylinder 42 includes a trunnion 52 mounted in a trunnion mount 50. The trunnion mount 50 enables the cylinder 42 to pivot along the axis of the trunnion pin 52. Thus, as the cylinder 42 is extended and retracted, the trunnion mount 50 enables the piston to rotate about the trunnion pin axis. As this occurs, the boom 32 is rotated about the bearing journal 46 which provides vertical movement at the end of the boom 32 that includes the rotary actuator 36. The cylinder 42 includes a mounting pin 54 that passes through a clevis 56 on the boom 32 so that the cylinder 42 is rotatably secured with the boom 32.

Figure 6:
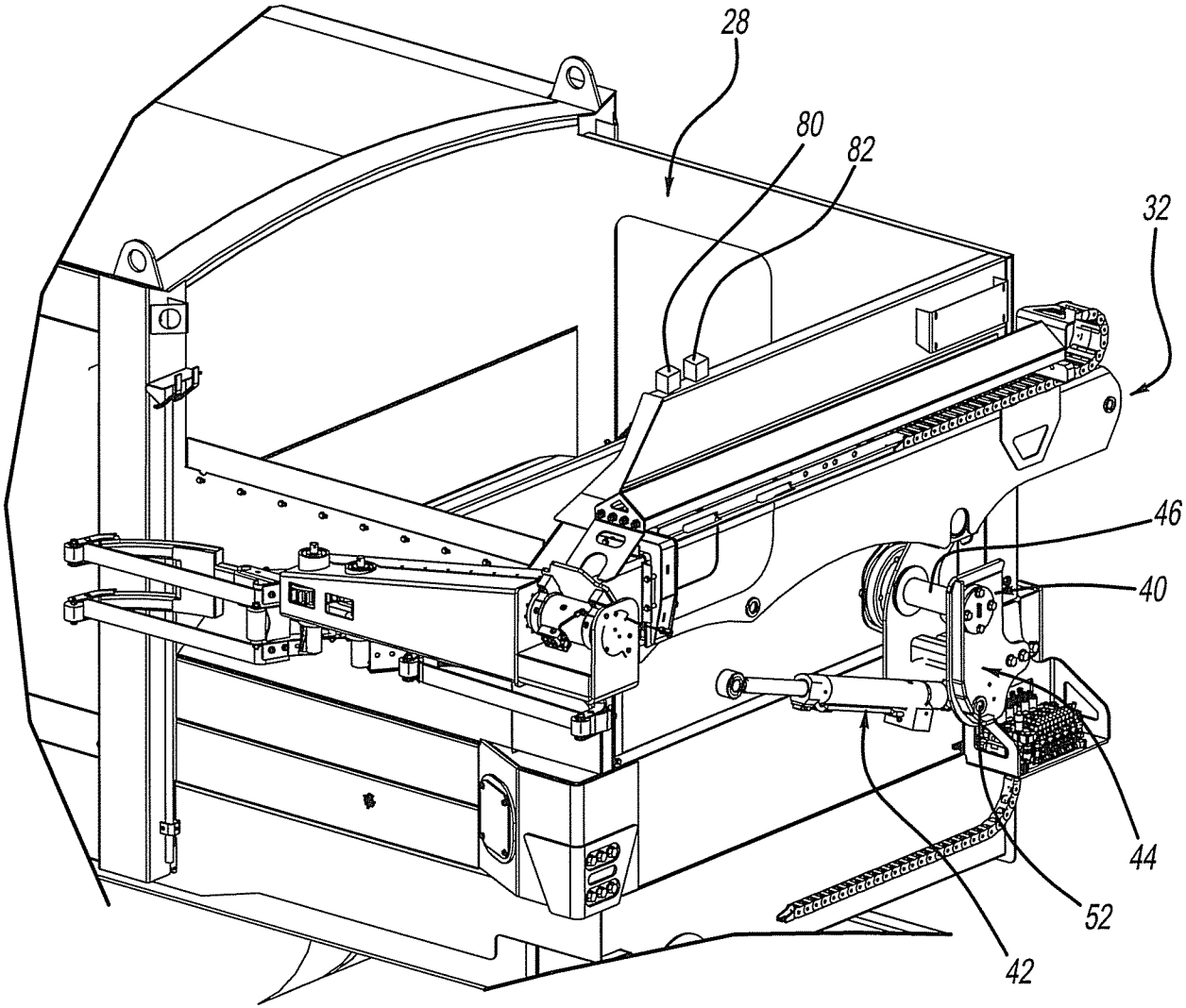
FIG. 6 is a perspective view of the telescoping arm removed from a pivot bearing assembly.

As can be seen in FIGS. 6 and 7, due to the nature of the mounting assembly 40, the container collection arm 30 can be easily removed from the mounting assembly 40. The container collection arm 30 can easily be repaired or replaced. Additionally, other types of arms, such as to pick up brush, cut trees, or the like, can be substituted for the container collection arm 30.

Figure 4:
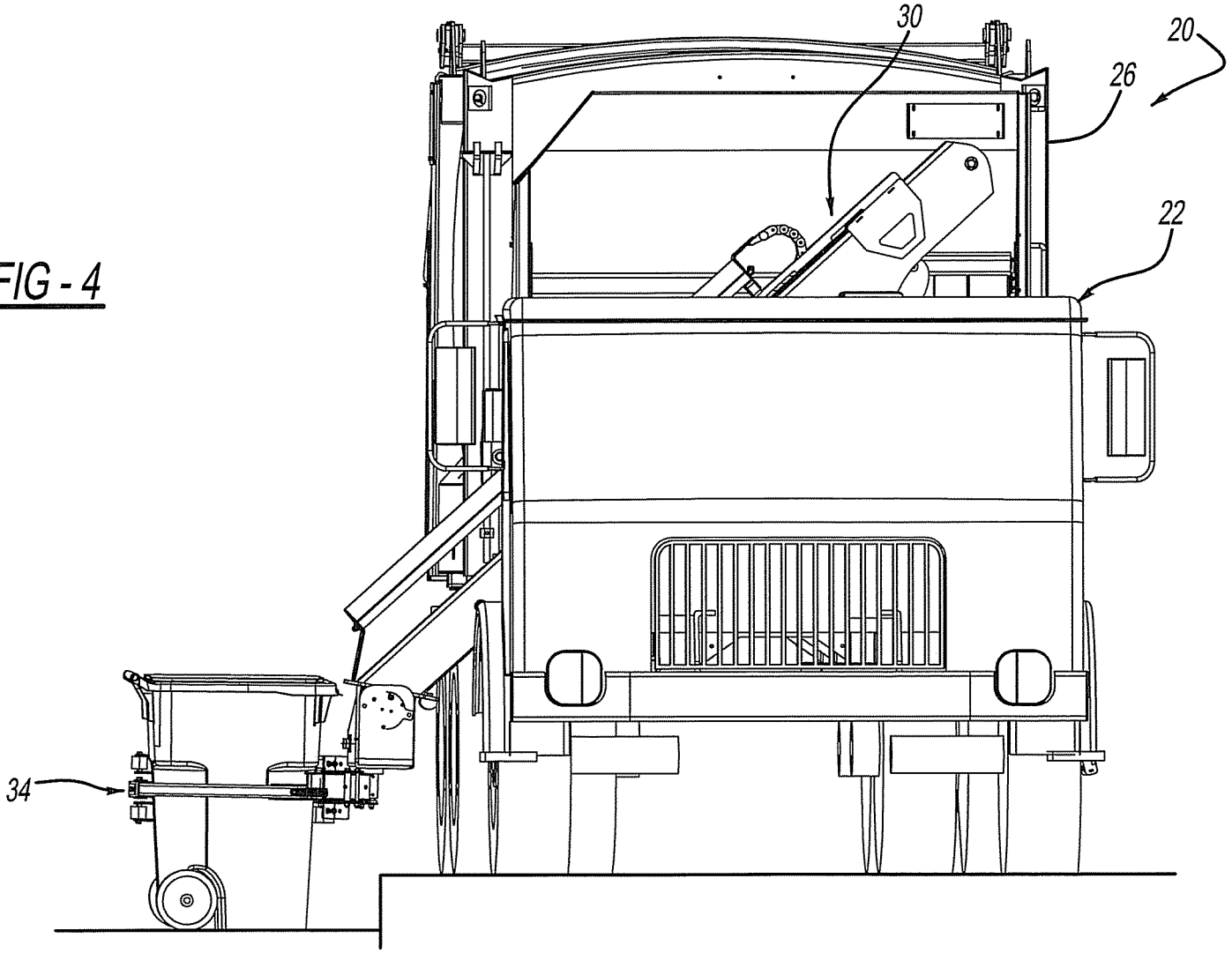
FIG. 4 is a front elevation view of the refuse collection vehicle with the collection arm extended to retrieve a container below the street grade level.
Figure 5:
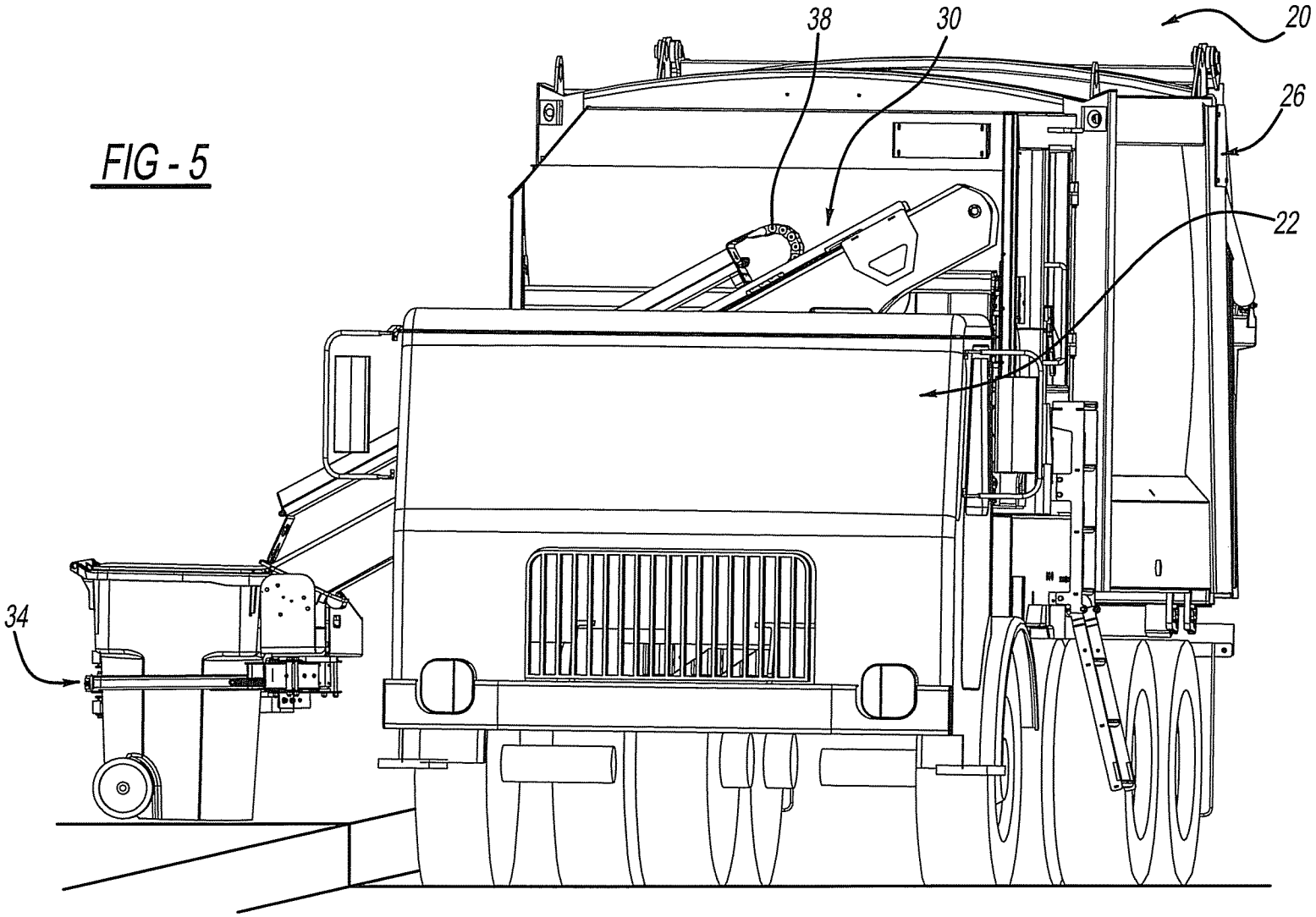
FIG. 5 is a perspective view of a refuse collection vehicle picking up a container above the street grade level.

Thus, by actuating the cylinder 42, the boom 32 may be moved in a first degree of movement to provide vertical movement of the grasping assembly 34. Additionally, the boom 32 can be extended to provide a second degree of freedom of movement to move the grasping assembly horizontally. Further, the rotary actuator 36 can be rotated up and/or down to compensate for grasping the container. Thus, the container collection arm 30 is capable of picking up containers above and below the street grade the vehicle is traveling on, as illustrated in FIGS. 4 and 5. Additionally, the movement enables the opening of the container to be parallel to the ground regardless of the grade. Thus, this prevents tipping and loss of refuse in the container.

Additionally, an operator override may be present to enable the grasping of containers that are above and below the street grade of the vehicle. This requires the arm to be taken out of a normal range of operation for grasping the containers. The grasping sequence can be overridden by the operator so that the containers may be picked up above and below street grade of the vehicle.

Figure 3:
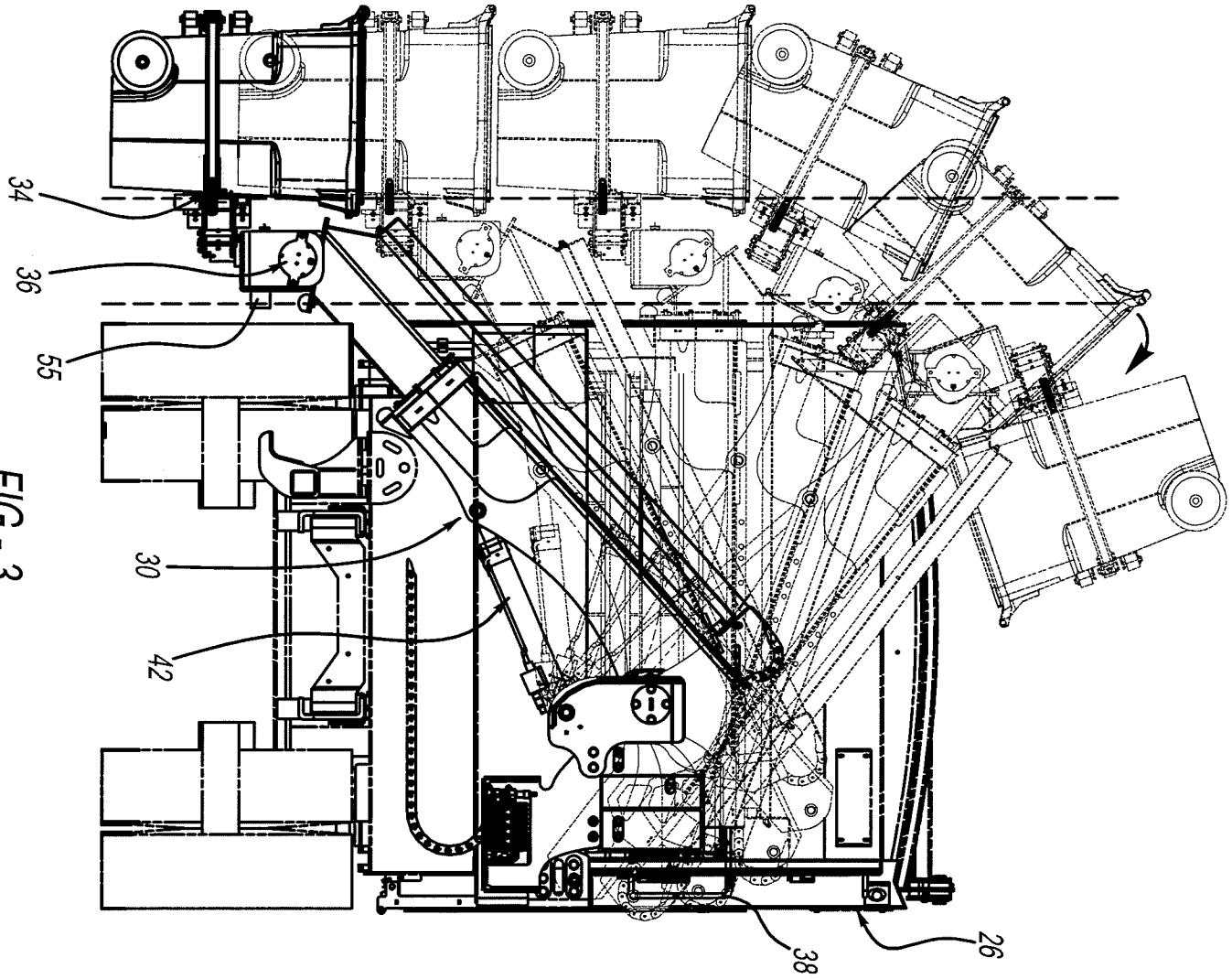
FIG. 3 is an elevation view like FIG. 2 illustrating a container moving from a pick up position to a dump position.

FIG. 3 illustrates the container collection arm 30 moving between a pick up and a dump position. Here, the boom 32 is extended slightly when the trash container is on the ground and grasped by the grasping mechanism 34. As the boom 32 is rotated upwardly, the piston cylinder 42 is extended. Additionally, the rotary actuator 36 compensates to maintain the container in an upright position as illustrated.

The piston cylinder 42 continues to extend as the boom continues to retract. Also, the rotary actuator 36 continues to rotate until the container reaches a dump position. As this occurs, the piston cylinder 42 is substantially extended through its entire stroke. The rotary actuator 36 is rotated so that the container dumps into the hopper 28. At this position, the rotary actuator 36 can be moved in a forward and reverse direction, as illustrated by the two ended arrow in FIG. 3, to "shake" the container to provide an extra refuse evacuation sequence during dumping. Alternatively, a vibration mechanism 55 may be secured with the grasping mechanism 34 to "shake" the container to provide an extra refuse evacuation sequence during dumping, as seen in FIG. 12. The cylinder 42, boom 32 and rotary actuator 36 are activated to reposition the container back onto the ground surface. Thus, the container collection arm 30 enables the container to be brought to a dumping location in a direct path from any reached distance while maintaining the container in an upright condition. This reduces the possibility of spillage of the container contents.

The rotary actuator 36 ensures that the container is emptied. The rotary actuator 36, vibration mechanism 55, or other shaking devices, not directly related to the lifting motion, will enable the containers to be emptied without adding loads and stresses to the main lifting stages of the boom 32. Additionally, a system to determine whether the container is empty may be added to the container collection arm 30. It will automatically modify the container collection arm 30 motion to empty the container. Container status can be derived from a number of methods such as weight, visual sensing, ultrasonic radar or the like which will transmit a signal back to the main lift controller. The information will be used to either initiate shaking of the container to empty its contents or prevent the operator from extraneous shaking movement of the container. This reduces wear on the lifting arm and increases operator productivity by eliminating unneeded actions at each collection point.

Additionally, a sensor 65 may be positioned on the rotary actuator link arm 35. The sensor 65 ensures that the link arm 35 is level with the grade of the ground. This enables the container opening to always be parallel with the ground prior to the dump sequence. This auto leveling feature enhances the ability to enable the container to be maintained upright as well as to be in a proper position for dumping. Also, sensor 65 will allow for the link arm 35 and grasping mechanism 34 to be rotated to a perpendicular position in reference to the ground so that containers that are not in an upright position can be collected.

The boom 32 includes a hydraulic manifold 60. The hydraulic manifold 60 includes connection portions 62 for the extended dump and end effector hoses. These are connected, via hoses, to the supply return of the hydraulic system. The positioning of the manifold 60 enables the hoses to be short and decreases the amount of movement of the hoses secured with the supply return mounted on the hopper 28. Additionally, supply lines 68 are positioned on the hopper 28 to operate the piston cylinder 42. The supply lines and actuator lines include quick disconnects so that they can be quickly connected and disconnected from one another.

Figure 1:
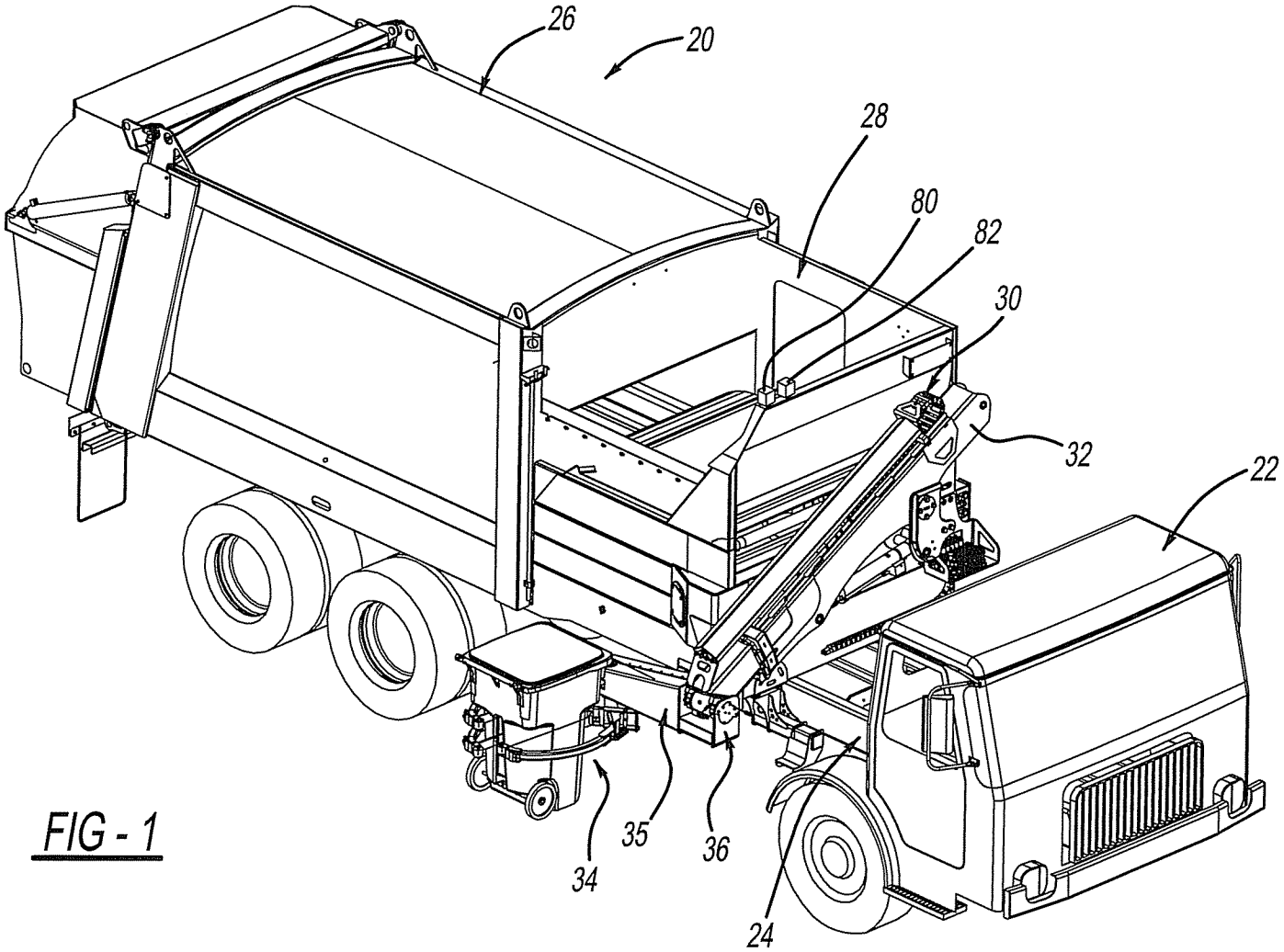
FIG. 1 is a perspective view of a refuse collection vehicle.
Figure 2:
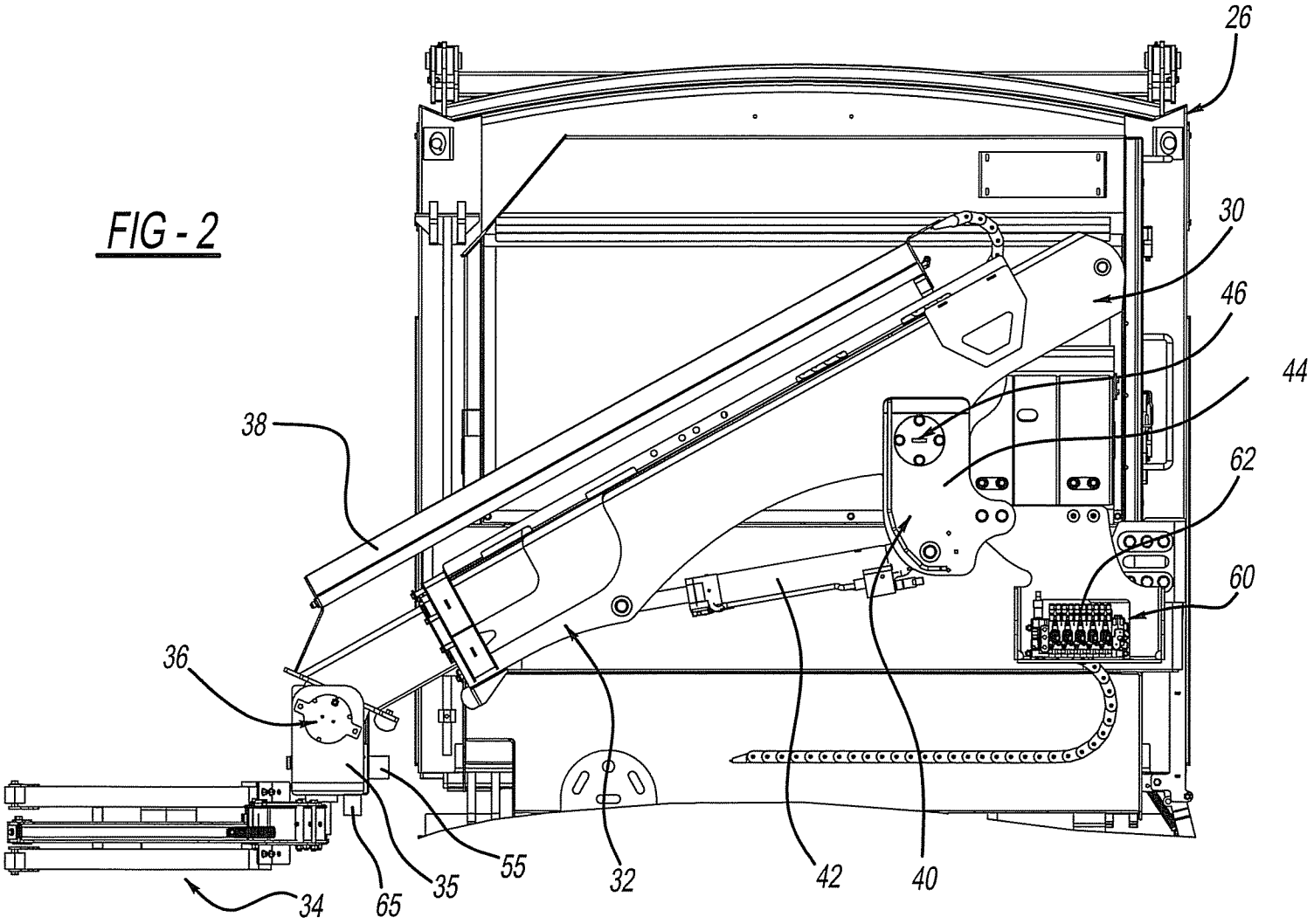
FIG. 2 is an elevation view of the telescoping arm on the refuse stowage unit.

Additionally, a camera 80 and a light 82 may be positioned onto the hopper 28 as illustrated in FIG. 1. The camera 80 and the light 82 provide the operator with a view of the container so that the container may be picked up by the operator from within the cab of the vehicle. The operator views a screen in the cab that illustrates the container. Thus, the camera 80 provides a view of the container so that the operator may easily grasp the container with the grasping mechanism 34. The screen may include some type of line scan or safety curtain to enable lining up and easy pick up of the container by the operator. Also, the light 82 may be present to provide illumination for the camera. This optimizes the field of view. The operator is provided with a controller, such as a joy stick, so that he would be able to manipulate the container collection arm 30 to pick up of the container. Once the container is grasped, the operator initiates the dumping sequence. The system determines the weight of the container and begin the dump sequence.

Also, the camera 80 may be mounted so that upon dumping of the container, the operator may view the inside of the container for a refuse verification check to ensure that the container is empty. Alternatively, the camera 80 and light 80 may be mounted on the container collection arm 30.

FIG. 8-11 illustrates a container pickup. In FIG. 8, the boom 32 is extended so that the grasping mechanism 34 is positioned about the container. In FIG. 9, the boom 32 has been retracted into a position to begin dumping the container. In FIG. 10, the boom has been rotated upwardly illustrating the relatively level vertical position of the container as it moves from the ground surface to the hopper 28. FIG. 11 illustrates the extension of the piston cylinder 42 and the rotation of the rotary actuator 36 to dump the container into the hopper 28.

Thus, the container collection arm 30 is rotatably coupled with the hopper 28 as well as including a rotatable actuator 36. This configuration enables the grasping mechanism 34 to be positioned so that it is perpendicular to a container at any distance in height within the working area of the container collection arm 30. This enables optimal engagement with the waste container to reduce the possibility of damaging the container or spilling its contents. The mounting assembly 40 is attached to the front of the hopper 28 to reduce the overall weight of the assembly by using the body structure to raise the boom 32 pivot point above the chassis where the container collection arm 30 reach can be maximized. The mounting position of the container collection arm 30 raises the attachment point of the container collection arm 30 to an area where it is easily serviceable so that quick change of the container collection arm 30 for service and repair is possible.

Methods of operating the collection device are as follows. The operator selects a direct path or a low lift path to the hopper. The operator grips the input controller (joystick or other). The system senses the operator is present. The operator approaches a container. As the vehicle slows down, below a preset speed, the joystick is enabled. The operator moves the control to a reach position. A signal is sent to the chassis to restrict the speed of any forward movement of the vehicle as soon as the arm leaves it's stored position. The boom cylinder extends, the lift cylinder extends to the level of the dump arm, and the rotary actuator rotates the grabber assembly and beam to assure that the container remains parallel to the ground. The operator, sensor, camera, or other device initiates closing of the grabber as the arms approach the container. When the optimum grabber point, as defined by the grabber and container type is reached, the extended functions are stopped. The container is firmly grabbed using a force feed back, grabbing the container. The operator moves the control lever to the dump position.

If the direct path is chosen, the controller calculates the most direct path to the hopper dumping position. Upon operator signal or after a preset time after the container is gripped, the container lifting and weighing is initiated. When the weight exceeds a preset limit, the operation of the arm will be slowed to control stresses within the arm structure. The boom cylinder is retracted, while the lift cylinder continues to extend until sensors reach the container raised position and is ready to dump. While raising the grabber, the beam continues to rotate to maintain the container level to the earth. While moving the container plus refuse, the weight is more precisely calculated. When reaching the dump position, the dump arm will rotate the container into the dump position emptying the contents into the hopper. If the container is not empty, a re-rotation of the dump arm/grabber is automatically initiated to dislodge the remaining contents. Alternatively, a vibratory or other method may be engaged to dislodge the container contents. When the container is determined to be empty, the container will be rotated back toward the level position. As soon as the container has rotated far enough to clear the edge of the hopper, the arm lift cylinder will begin retracting to lower the container. The boom cylinder will extend to return the container to the position as it was picked up. The controller will follow the reverse path of the lift cycle to directly return the container.

If the low lift path is chosen, upon operator signal or after a preset time after verifying the container is gripped, the boom cylinder is retracted, while the lift cylinder continues to retract until sensors determine the container has reached the side of the vehicle body. The container is maintained at a height that is raised slightly to clear the ground surface while it is retracted. Upon operator signal or after a preset time after the container is gripped, container lifting and weighing is initiated. When the weight exceeds a preset limit, the operation of the arm will be slowed to control stresses within the arm structure. While retracting the grabber, the beam continues to rotate to maintain the container level to the earth. As soon as the container reaches the side of the vehicle body, the lift cylinder begins to extend, and the boom cylinder extends then retracts to compensate for the rotary motion. As the grabber is raised, the beam continues to rotate to maintain the container level to the earth. While moving the container plus the refuse, the weight is more precisely calculated. When the dump position is reached, the dump arm will rotate the container into the dump position emptying its contents into the hopper. If the container is not empty, a re-rotation of the dump cylinder is automatically initiated to dislodge its contents. Alternatively, a vibratory or other method may be engaged to dislodge the container of its contents. When the container is determined to be empty, the container is rotated back toward the level position. As soon as the container has rotated far enough to clear the edge of the hopper, the arm lift cylinder begins to retract lowering the container. Also, the boom cylinder extends to return the container to the position as it was picked up. The controller will follow the reverse path of the lift cycle to directly return the container to the lower position at the side of the vehicle body. The controller will then automatically extend the boom and raise cylinder, while rotating the dump arm to return the container to the pickup position. When the container is at the pickup position, the operator will command the grabber to release the container. The grabber will open. As soon as the grabber has retracted far enough from the container, the boom cylinder and lift cylinder will start to retract. The boom will pull in with the grabber remaining level to the stored position. A signal is sent to the chassis to allow full vehicle speed.

Turning to FIGS. 14 and 15, an additional embodiment is illustrated. The collection vehicle, including the cab 22, frame 24, refuse stowage unit 26 and hopper 28, is substantially identical. Here, the difference is in the container collection arm 130. Again, the container collection arm 130 includes a telescoping boom 132 secured with the hopper 28. The boom 132 is secured with the hopper 28 so that the boom 132 provides horizontal movement at a constant height. An arm 130 is secured with the end of the telescoping boom 132. The other end of the arm 130 includes a grasping mechanism 134 to grab refuse containers. The arm 130 includes a plurality of rotary actuators 136, 138, 140. The rotary actuators 136, 138, 140 are provided at pivot locations of the arm 130. Thus, the arm includes links 142, 144 between the rotary actuators 136, 138, 140. The links 142, 144 pivot about the rotary actuators to enable the container to be moved from the collection to the dump position as illustrated in FIG. 15. Thus, the container is picked up as the rotary actuators 136, 138, 140 rotate to pivot the links 142, 144 with respect to one another to enable the waste container to be dumped into the hopper 28, as illustrated in FIG. 15.

FIGS. 16 and 17 illustrate an additional embodiment of the disclosure. The collection vehicle is substantially the same as that described including a cab 22, a frame 24, a refuse stowage unit 26 and a hopper 28. The container collection arm 230 is positioned underneath the hopper 28. The container collection arm 230 includes a telescoping boom 232 that includes a grasping mechanism 234. The grasping mechanism 234 moves vertically along a support 236. The telescoping boom 232 extends horizontally from the vehicle to grasp a container. The telescoping boom 232 is retracted into the vehicle. The telescoping boom aligns the support 236 with a track 238 having a candy cane configuration. The grasping mechanism 234 begins to ride upward along the support 236 and then onto the candy cane track 238 to a dump position as illustrated in FIG. 17.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A refuse collection vehicle comprising:

a vehicle having a forward direction of travel and a rearward direction of travel;

a refuse stowage unit secured to the vehicle, the refuse stowage unit comprising a hopper configured to receive refuse; and an arm constrained to movement within a plane in a transverse direction relative to the forward and rearward directions of travel, the arm configured to grasp containers from a location on one side of the vehicle and empty the containers in the hopper, the arm including:

a rail system coupled to a vertical surface of the hopper facing a cab of the vehicle, a mounting assembly comprising a base coupled to the rail system, a rail cylinder coupled to the rail system and the base, the rail cylinder configured to extend and retract to provide movement of the base along the rail system across the hopper in the transverse direction, a telescoping boom directly attached to the base by a bearing received by the rail system, the telescoping boom configured to rotate about the bearing relative to the hopper, a first actuator for telescopically extending and retracting the telescoping boom relative to the rail system and the hopper, a pivot cylinder rotatably coupled between the telescoping boom and the base, a distal end of the pivot cylinder attached to the boom and a proximal end of the pivot cylinder attached to the base, the pivot cylinder configured to extend and contract to provide vertical movement of a free end of the telescoping boom, a grasping mechanism coupled to the telescoping boom, the grasping mechanism adapted for grasping containers, the grasping mechanism including at least one rotatable actuator configured to move the container between a pick up position and an empty position, and the grasping mechanism including at least one moveable finger configured to couple with the containers for enabling pick up of the containers, and a hose track housing one or more hydraulic hoses, the hydraulic hoses coupled to the grasping mechanism, the hose track coupled to the telescoping boom and configured to move along the boom during operation of the arm; and a controller configured to receive user input and regulate operation of the first actuator and the pivot cylinder to selectively move the arm in alternative direct-path and low-lift-path dump modes based on the user input, wherein:

in the direct-path dump mode, operation of the first actuator retracts the telescoping boom while the pivot cylinder extends to move the free end of the telescoping boom vertically upward; and in the low-lift-path dump mode, operation of the first actuator retracts the telescoping boom while the pivot cylinder retracts to move the free end of the telescoping boom vertically downward.

2. The refuse collection vehicle of claim 1, wherein the arm is removable from the vehicle.

3. The refuse collection vehicle of claim 1, wherein the arm enables pick up of containers above and below a street grade on which the vehicle is traveling.

4. The refuse collection vehicle of claim 1, wherein the rotatable actuator couples the grasping mechanism to the telescoping boom.

5. The refuse collection vehicle of claim 1, wherein the distal end of the pivot cylinder is attached to the boom at a boom clevis, and wherein the proximal end of the pivot cylinder is attached to the base at a base trunnion.

6. An arm for a refuse vehicle having a forward direction of travel and a reward direction of travel, the arm constrained to movement within a plane in a transverse direction relative to the forward and rearward directions of travel, the arm comprising:

a rail system configured to be coupled to a vertical surface of a hopper of the refuse vehicle;

a mounting assembly comprising a base coupled to the rail system;

a telescoping boom directly attached to the base by a bearing received by the rail system, the telescoping boom configured to rotate about the bearing relative to the hopper, a first actuator for telescopically extending and retracting the telescoping boom relative to the rail system and the hopper, a pivot cylinder rotatably directly attached to the telescoping boom and the base, a distal end of the pivot cylinder attached to the boom and a proximal end of the pivot cylinder attached to the base, the pivot cylinder configured to extend and contract to provide vertical movement of a free end of the telescoping boom, a grasping mechanism coupled to the telescoping boom, the grasping mechanism adapted for grasping containers, the grasping mechanism including at least one rotatable actuator configured to move the containers between a pick up position and an empty position, and the grasping mechanism including at least one moveable finger configured to couple with the containers for enabling pick up of the containers, and a hose track housing one or more hydraulic hoses, the hydraulic hoses coupled to the grasping mechanism, the hose track coupled to the telescoping boom and configured to move along the boom during operation of the arm, wherein the first actuator and the pivot cylinder are configured to operate in response to control signals and selectively move the arm in alternative direct-path and low-lift-path dump modes, wherein:

in the direct-path dump mode, operation of the first actuator retracts the telescoping boom while the pivot cylinder extends to move the free end of the telescoping boom vertically upward; and in the low-lift-path dump mode, operation of the first actuator retracts the telescoping boom while the pivot cylinder retracts to move the free end of the telescoping boom vertically downward.

7. The arm of claim 6, wherein the arm is removable from a vehicle.

8. The arm of claim 6, wherein the arm enables pick up of containers above and below grade of a street on which a vehicle is traveling.

9. The arm of claim 6, further comprising a sensor providing signals to a controller to automatically level the grasping mechanism to assure that an opening of a picked up container is parallel to a ground surface.

10. The arm of claim 6, further comprising a mechanism for enhancing refuse evacuation during a dumping sequence.

11. The arm of claim 10, wherein the mechanism is a vibratory mechanism.

12. The arm of claim 6, further comprising a sensor for determining a weight value of the container.

13. The arm of claim 6, further comprising a camera for enabling viewing by an operator for picking up a container.

14. The arm of claim 6, wherein the distal end of the pivot cylinder is attached to the boom at a boom clevis, and wherein the proximal end of the pivot cylinder is attached to the base at a base trunnion.

15. A refuse collection vehicle comprising:

a vehicle having a forward direction of travel and a rearward direction of travel;

a refuse stowage unit secured to the vehicle, the refuse stowage unit comprising a hopper configured to receive refuse; and an arm constrained to movement within a plane in a transverse direction relative to the forward and rearward directions of travel, the arm configured to grasp containers from a location on one side of the vehicle and empty the containers in the hopper, the arm including:

a rail system coupled to a vertical surface of the hopper facing a cab of the vehicle, a mounting assembly comprising a base coupled to the rail system, a rail cylinder coupled to the rail system and the base, the rail cylinder configured to extend and retract to provide movement of the base along the rail system across the hopper in the transverse direction, a telescoping boom directly attached to the base by a bearing received by the rail system, the telescoping boom configured to rotate about the bearing relative to the hopper, a first actuator for telescopically extending and retracting the telescoping boom relative to the rail system and the hopper, and a pivot cylinder rotatably coupled between the telescoping boom and the base, a distal end of the pivot cylinder attached to the boom and a proximal end of the pivot cylinder attached to the base, the pivot cylinder configured to extend and contract to provide vertical movement of a free end of the telescoping boom; and a controller configured to receive user input and regulate operation of the first actuator and the pivot cylinder to selectively move the arm in alternative direct-path and low-lift-path dump modes based on the user input, wherein:

in the direct-path dump mode, operation of the first actuator retracts the telescoping boom while the pivot cylinder extends to move the free end of the telescoping boom vertically upward; and in the low-lift-path dump mode, operation of the first actuator retracts the telescoping boom while the pivot cylinder retracts to move the free end of the telescoping boom vertically downward.

16. The refuse collection vehicle of claim 15, further comprising a grasping mechanism coupled to the telescoping boom, the grasping mechanism adapted for grasping containers, the grasping mechanism including at least one rotatable actuator configured to move the container between a pick up position and an empty position, and the grasping mechanism including at least one moveable finger configured to couple with the containers for enabling pick up of the containers.

17. The refuse collection vehicle of claim 15, further comprising a hose track housing one or more hydraulic hoses, the hose track coupled to the telescoping boom and configured to move along the boom during operation of the arm.

18. The refuse collection vehicle of claim 15, wherein the distal end of the pivot cylinder is attached to the boom at a boom clevis, and wherein the proximal end of the pivot cylinder is attached to the base at a base trunnion.

* * * * *